US005908601A

United States Patent [19]

Lin

[11] Patent Number: 5,908,601

[45] Date of Patent: Jun. 1, 1999

[54] BAD ODOR ELIMINATING DEVICE

[76] Inventor: Chien-Hung Lin, 3F, No. 145-1 Nanking E. Rd. Sec. 5, Taipei, Taiwan

[21] Appl. No.: 08/968,757

[22] Filed: Oct. 8, 1997

[51] Int. Cl.[6] ..... A62B 7/08

[52] U.S. Cl. ..... 422/122; 422/105; 422/107; 422/120; 422/124

[58] Field of Search ..... 422/122, 124, 422/105, 107

[56] References Cited

U.S. PATENT DOCUMENTS

| | | | |
|---|---|---|---|
| 4,295,343 | 10/1981 | Izumi | 62/309 |
| 5,335,425 | 8/1994 | Tomizawa et al. | 34/265 |
| 5,778,822 | 7/1998 | Giffin et al. | 119/165 |

*Primary Examiner*—Krisanne Thornton
*Attorney, Agent, or Firm*—Bacon & Thomas, PLLC

[57] ABSTRACT

A bad odor eliminating device especially useful at the throw-in gate of the closed type waste receiving space such as a garbage storage tank, a resources recovery case etc., when the/throw-in gate is opened, the device can create negative pressure around the throw-in gate, so that air in the waste receiving space will not sread out, and therefore bad odor will not be released. The device includes mainly a window frame, a wind drawing pipe and a filter, a fan is also provided to create the above stated negative pressure on an air guiding groove at the circumference of the window frame and the throw-in gate to absorb air with bad odor to filter out dust in the air and do ion exchanging with the filter to eliminate bad odor. An object of getting sanitary circumstances can thus be achieved.

1 Claim, 2 Drawing Sheets

BAD ODOR ELIMINATING DEVICE

BACKGROUND OF THE INVENTION

1. Field of the Invention

The present invention relates to a bad odor eliminating device especially useful at the throw-in gate of the closed type waste receiving space such as a garbage storage tank, a resources recovery case etc., when the throw-in gate is opened, the device can create negative pressure around the throw-in gate, so that air in the waste receiving space will not sread out, and therefore bad odor will not-be released, an object of getting sanitary circumstances can be achieved.

2. Description of the Prior Art

It is well known that organic substance such as residue of foods and fruit juice will be resolved and ferment when it is placed at a position too long, during fermenting, a great amount of bad odor will be released, it is so bad to suffer such odor, people normally walk fast to pass a heap of garbage with their noses covered in order to avoid smelling of such bad odor.

In a closed space, such bad odor released can be much more disgusting. This is because that, when organic substance ferments, in addition to bad odor, heat will be released, while air flow is retarded in the closed space, temperature therein will be higher than that outside of it, the higher temperature therein will accelerate fermentation, generation of bad odor is more serious here.

Generation of bad odor in such a closed space generally can be the worst in a garbage storing tank and a resources recovery case. This is mainly because they are designed to be sealed in order to prevent bad odor from emitting and to prevent rain from flowing in, only a throw-in gate is provided for each of them, so that when a user is to throw waste into it, a cover must be lifted up. When the cover is opened, fermentation and raising of temperature therein will render air pressure therein to be slightly higher than that outside of the space, so that at the instant when the cover is opened, air with bad odor in the space will largely emit and rush to the user opening the cover, this is terribly hard to suffer and is very disgusting.

SUMMARY OF THE INVENTION

In view of the fact that a closed space is subject to generating of bad odor to make people unpleasant, the inventor of the present invention provides a bad odor eliminating device based on his professional experience of years in designing and developing practising in relation to various garbage storing tanks as well as related equipments and after continuous study and improving, for eliminating disadvantage resided in the prior art.

Particularly, the bad odor eliminating device of the present invention is especially useful at the throw-in gate of the closed type waste receiving space such as a garbage storage tank, a resources recovery case etc., it is comprised of a window frame, a wind drawing pipe and a filter, wherein:

The window frame is fitted over the periphery of the throw-in gate of a storing tank, an air guiding groove is provided in the inner side thereof and along its periphery, the air guiding groove is continuous over all the periphery and is led to an air suction port; a cover and a switch are provided at the bottom of the window frame, when the cover is opened, the switch can be turned on.

The wind drawing pipe is connected to the air suction port of the window frame and is extended out of the storing tank, and also is provided with a receiving portion at the end thereof for receiving a fan which is provided with a discharging hole at the rear end thereof, the above mentioned switch can be activated to rotate the fan for drawing air out from the discharging hole.

The filter is placed in the receiving portion at the end of the wind drawing pipe and is constructed by a plurality of mesh ion exchangers placed one after another to be arranged in front of the discharging hole of the receiving portion, air from the discharging hole will then pass the filter firstly.

By means of the above stated structure, when a user opens the cover of the window frame to throw in waste, the switch is activated to turn on the fan, the fan draws air from the wind drawing pipe and the air suction port to create a negative pressure on the air guiding groove, so that air with bad odor in the storing tank will not be released, yet discharged air from the storing tank through the filter will have no bad odor, because the filter has filtered out the dust in the air and has the function of ion exchaning.

Accordingly, the main object of the present invention is to provide a bad odor eliminating device especially useful for the closed type waste receiving space such as a garbage storage tank, a resources recovery case etc., by means of such structure, when a user opens the throw-in gate, air with bad odor in the closed type waste receiving space will not be released, thus sanitary condition can be improved.

The present invention will be apparent in its practical structure and characteristics after reading the detailed description of the preferred embodiment thereof in reference to the accompanying drawings.

DETAILED DESCRIPTION OF THE PREFERRED EMBODIMENT

Figure 1:
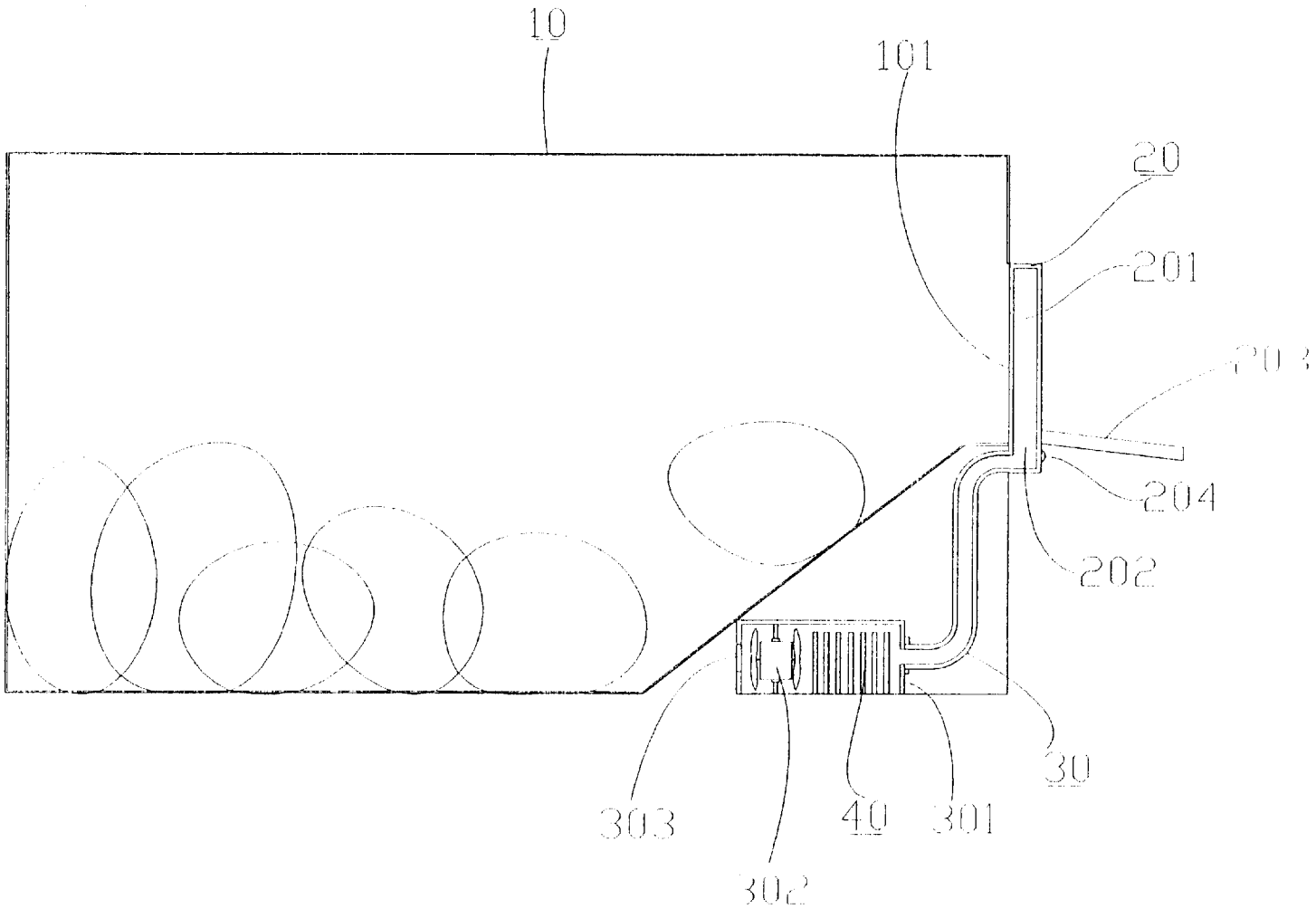
FIG. 1 is a view showing an embodiment of the present invention.
Figure 2:
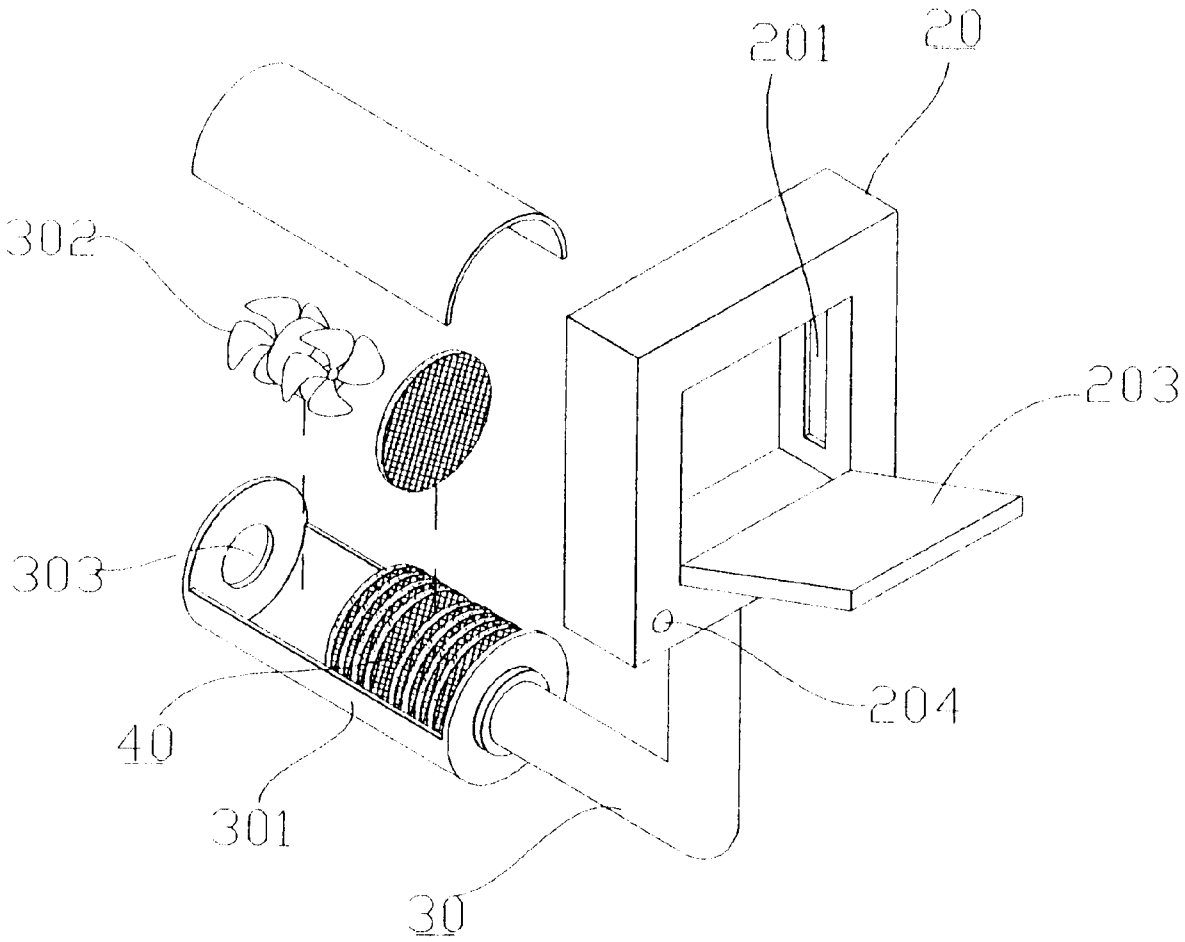
FIG. 2 is an analytic perspective view of the present invention.

In the drawings:

Referring to FIGS. 1 and 2, We can see a bad odor eliminating device of the present invention especially useful at the throw-in gate 101 of the closed type waste receiving space such as a garbage storage tank or a resources recovery case 10 etc., when the throw-in gate 101 is opened, a negative pressure will be created at the cirference of the throw-in gate 101, so that air with bad odor in the storing tank 10 will not be released, thus an object of obtaining sanitary condition can be achieved.

The bad odor eliminating device of the present invention is comprised of a window frame 20, a wind drawing pipe 30 and a filter 40, wherein:

The window frame 20 is fitted over the periphery of the throw-in gate 101 of the storing tank 10, an air guiding groove 201 is provided in the inner side thereof and along its periphery, the air guiding groove 201 is continuous over all the periphery and is led to an air suction port 202; a cover 203 and a switch 204 are provided at the bottom of the window frame 20, when the cover 203 is opened, the switch 204 can be turned on.

The wind drawing pipe 30 is connected to the air suction port 202 of the window frame 20 and is extended out of the storing tank 10, and also is provided with a receiving portion

301 at the end thereof for receiving a fan 302 which is provided with a discharging hole 303 at the rear end thereof, the above mentioned switch 204 can be activated to rotate the fan 302 for drawing air out of the discharging hole 303.

The filter 40 is placed in the receiving portion 301 at the end of the wind drawing pipe 30, and is constructed by a plurality of mesh ion exchangers placed one after another to be arranged in front of the discharging hole 303 of the receiving portion 301, air with dust from the discharging hole 301 will then be filtered and is treated by ion exchanging in the filter 40 firstly to eliminate bad odor therein.

By means of the above stated structure, when a user opens the cover 203 of the window frame 20 to throw in waste through the throw-in gate 101, the switch 204 is activated to turn on the fan 302, the fan 302 draws air from the wind drawing pipe 30 and the air suction port 202 to create suction force by a negative pressure created on the air guiding groove 201 provided at the circumference of the window frame 20, so that air with bad odor in the storing tank 10 will not be released from the throw-in gate 101, yet discharged air passes through the air guiding groove 201, the air suction port 202, the wind drawing pipe 30, the filter 40, and out of the discharging hole 303. When air passes through the filter 40, there will be no bad odor in the air discharged from the discharging hole 303, because the filter 40 has eliminated bad odor by filtering out the dust in the air and treating by ion exchanging.

The embodiment of the present invention used on a garbage storage tank is for eliminating bad odor from the garbage storage tank, when the throw-in gate is opened, air with bad odor in the storing tank will not be released, therefore, sanitary condition can be improved.

Having thus described the technical structure of my invention with practicability and improveness, what I claim as new and desire to be secured by Letters Patent of the United States is:

1. A bad odor eliminating device, comprising:

a window frame fitted over a periphery of a throw-in gate of a storing tank, an air guiding groove being provided in an inner side of said window frame and along its periphery, said air guiding groove being continuous over all said periphery and being connected to an air suction port; a cover and a switch being provided at a bottom of said window frame and arranged such that when said cover is opened to access said throw-in gate, said switch is turned on;

a wind drawing pipe, connected to said air suction port of said window frame and extending out of said storing tank, said wind drawing pipe being provided with a receiving portion at an end thereof for receiving a fan and being provided with a discharging hole at a rear end thereof, said switch being arranged to be turned on to rotate said fan for discharging air from from said discharging hole; and a filter placed in said receiving portion at the end of said wind drawing pipe, said filter including a plurality of mesh ion exchangers placed one after another in front of said discharging hole of said receiving portion, wherein air with dust from said discharging hole is filtered and treated by ion exchange in said filter to eliminate the bad odor therein; and whereby when a user opens said cover of said window frame to throw in waste through said throw-in gate, said switch is activated to turn on said fan which draws air from said wind drawing pipe and said air suction port to create a suction force with a negative pressure in said air guiding groove at the circumference of said window frame, so that air with the bad odor in said storing tank will not be released from said throw-in gate and will be discharged through said air guiding groove, said air suction port, and said discharging hole, so that there will be no bad odor in the air discharged from said discharging hole, and air with a bad odor will be kept in said storing tank.

* * * * *